United States Patent [19]

Seyfried

[11] Patent Number: 4,891,674

[45] Date of Patent: Jan. 2, 1990

[54] RETRACTABLE DEVELOPMENT APPARATUS

[75] Inventor: Joseph A. Seyfried, Webster, N.Y.

[73] Assignee: Xerox Corporation, Stamford, Conn.

[21] Appl. No.: 204,332

[22] Filed: Jun. 9, 1988

[51] Int. Cl.[4] ..... G03G 15/01

[52] U.S. Cl. ..... 355/245; 355/251; 355/326; 118/645; 118/657

[58] Field of Search ..... 355/30 D, 14 D, 4, 245, 355/251, 326; 118/645, 656–658, 681

[56] References Cited

U.S. PATENT DOCUMENTS

| | | | |
|---|---|---|---|
| 3,854,449 | 12/1974 | Davidson | 118/681 |
| 3,906,897 | 9/1975 | Davidson | 118/681 |
| 3,940,272 | 2/1976 | Davidson | 430/126 |
| 4,330,198 | 5/1982 | Matsumoto et al. | 355/251 |
| 4,339,196 | 7/1982 | Beck et al. | 355/251 |
| 4,352,552 | 10/1982 | Stange | 355/326 |
| 4,473,028 | 9/1984 | Ito et al. | 118/653 |
| 4,652,113 | 3/1987 | Watanabe | 355/30 D |
| 4,746,954 | 5/1988 | Matuura et al. | 355/251 |

*Primary Examiner*—A. T. Grimley
*Assistant Examiner*—J. Pendergrass
*Attorney, Agent, or Firm*—H. Fleischer; J. E. Beck; R. Zibelli

[57] ABSTRACT

An apparatus in which a latent image is developed with developer material. An applicator roller has developer material adhering releasably to at least a portion of the exterior surface thereof. The applicator roller rotates and translates from an non-operative position spaced from the latent image to an operative position closely adjacent the latent image. In this way, the applicator roller transports developer material to the latent image. After development is completed, rotation and translation of the applicator roller is reversed to return the applicator roller to the non-operative position terminating development. An apparatus of this type is used in a multicolor electrophotographic printing machine wherein successive latent images are developed with different color developer materials and the respective developer materials are prevented from co-mingling on the same latent image.

14 Claims, 2 Drawing Sheets

RETRACTABLE DEVELOPMENT APPARATUS

Figure 1:
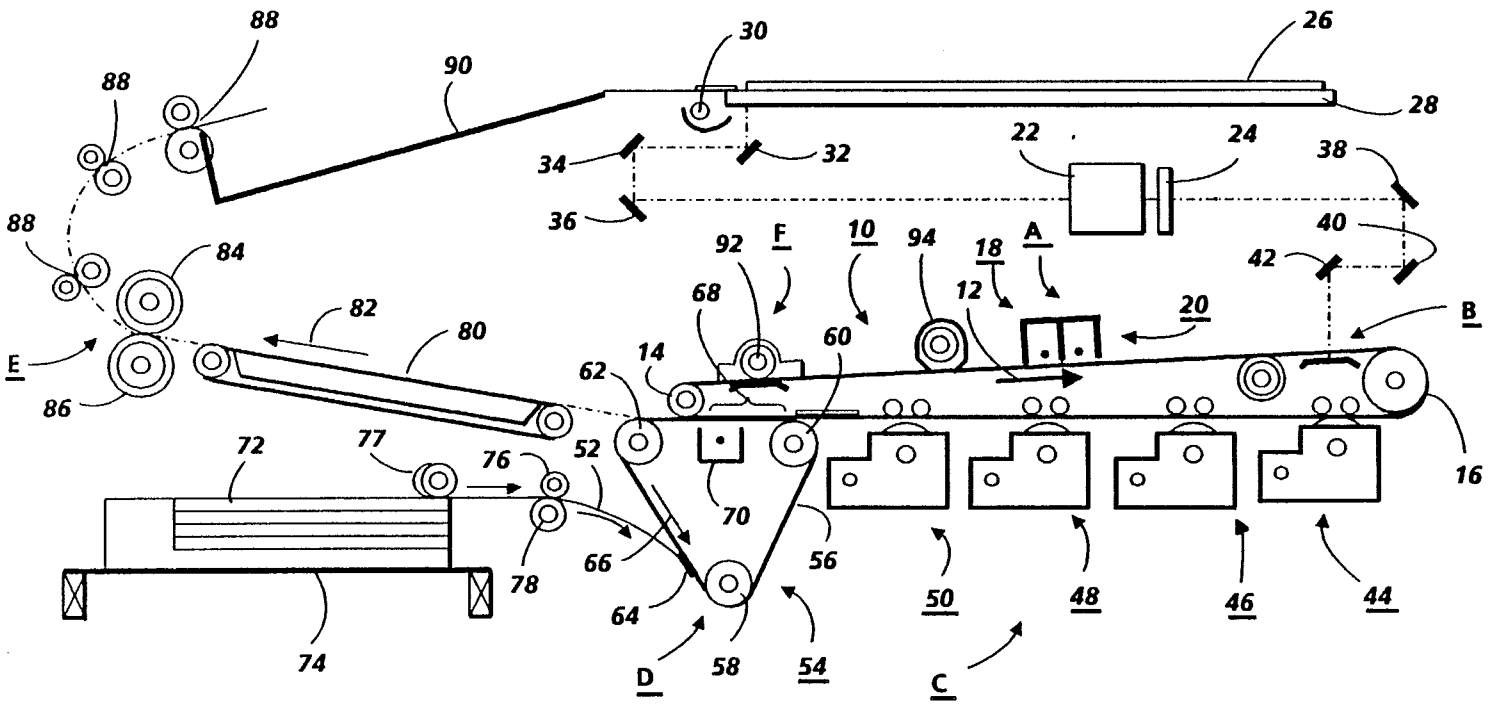

This invention relates generally to an electrophotographic printing machine, and more particularly concerns an improved development apparatus for use therein.

In an electrophotographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. The records an electrostatic latent image on the photoconductive member corresponding to the informational areas contained within the original document being reproduced. After the electrostatic latent image is recorded on the photoconductive member, the latent image is developed by bringing marking particles into contact therewith. This forms a powder image on the photoconductive member which is subsequently transferred to a copy sheet. The copy sheet is heated to permanently affix the marking particles thereto in image configuration.

Various types of development systems have hereinbefore been employed. These systems utilize two component developer mixes or single component developer materials. Typical two component developer mixes employed are well known in the art, and generally comprise dyed or colored thermoplastic powders, known in the art as toner particles, which are mixed with coarser carrier granules, such as ferromagnetic granules. The toner particles and carrier granules are selected such that the toner particles acquire the appropriate charge relative to the electrostatic latent image recorded on the photoconductive surface. When the developer mix is brought into contact with the charged photoconductive surface the greater attractive force of the electrostatic latent image recorded thereon causes the toner particles to transfer from the carrier granules and adhere to the electrostatic latent image.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner particles of a color complimentary thereto. This process is repeated a plurality of cycles for differently colored images and their respective complimentarily colored toner particles. Each single color toner powder image is transferred to the copy sheet in superimposed registration with the prior toner powder image. This creates a multi-layered toner powder image on the copy sheet. Thereafter, the multi-layered toner powder image is permanently affixed to the copy sheet creating a color copy.

Heretofore, development systems have employed rotary impellers, fur brushes, bucket conveyors and magnetic brush systems to achieve the requisite uniformity in toner deposition. The magnetic brush system achieves a high degree of uniform deposition and, therefore, numerous electrophotographic printing machines utilize this type of development system. Usually, a magnetic brush system includes a developer roller having a directional magnetic flux field to bring the magnetizable developer mix into contact with the charged photoconductive surface.

Generally, the developer roller of the magnetic brush development system is mounted fixedly relative to the photoconductive surface. This restricts the quality of multicolor copies. A multicolor development system utilized a plurality of developer rollers, each being adapted to furnish the appropriately colored toner particles to the photoconductive surface. Developer rollers which are fixedly mounted are positioned closely adjacent to the photoconductive surface. In this way, the developer roller having the developer mix adhering thereto deposits toner particles on the photoconductive surface. However, when a developer mix having toner particles of one color contacts the toner powder image of another color intermingling of colors and mechanical scraping of the toner powder image occurs. This results in the toner powder image being wrongly colored and the multicolor copy produced thereby lacking the appropriate color balance, i.e. the color does not correspond to the color in the original document being copied. To overcome this problem, the developer housings have been mounted movably in the printing machine. Thus, one developer housing is positioned in the operative location with the remaining developer housings being spaced from the photoconductive surface. In this way, successive developer housings are located adjacent the photoconductive surface to develop the electrostatic latent image while the other developer housings remain spaced therefrom in the non-operative position. An electrophotographic printing machine utilizing the foregoing type of development system is the Model No. 6500 made by the Xerox Corporation. Various approaches have been used to develop latent images in electrophotographic printing machines. The following disclosures appear to be relevant:

US-A-3,854,449
Patentee: Davidson
Issued: December 17, 1974
US-A-3,906,897
Patentee: Davidson
Issued: September 23, 1975
US-A-3,940,272
Patentee: Davidson
Issued: February 24, 1976
US-A-4,330,198
Patentee: Matsumoto et al.
Issued: May 18, 1982
US-A-4,339,196
Patentee: Beck et al.
Issued: July 13, 1982
US-A-4,352,552
Patentee: Stange
Issued: October 5, 1982
US-A-4,473,028
Patentee: Ito et al.
Issued: September 25, 1984

The relevant portions of the foregoing disclosures may be briefly summarized as follows:

U.S. Pat. Nos. 3,854,449, 3,906,897 and 3,940,272 disclose a multicolor electrophotographic printing machine employing a developer unit having a housing mounted pivotably therein. A spring resiliently urges the housing to pivot to the non-operative position, wherein the developer roller is spaced from the photoconductive drum, when the paddle wheel conveyor is de-energized. When the paddle wheel conveyor is energized, the torque applied on the housing pivots the housing so as to position the developer roller in the operative position, adjacent the photoconductive drum.

U.S. Pat No. 4,330,198 describes a magnetic brush developing device for an electrostatic copying apparatus wherein a magnetic brush, which is formed on a surface of the magnetic roller, is prevented from remaining in contact with the electrostatic latent image retaining member. The magnetic roller is connected to driving means via a one-way clutch.

U.S. Pat. No. 4,339,196 describe an electrocopying machine having a photoconductive surface and a retractable pivotably mounted developer unit having a camming system for moving the developer unit into and out of developing engagement with the photoconductive surface.

U.S. Pat. No. 4,352,552 discloses a magnetic brush development system used in a multicolor electrophotographic printing machine in which the direction of rotation of the developer roller is reversed so as to move the developer material away from the latent image.

U.S. Pat. No. 4,473,028 describes a developing device for an electrophotographic copying machine including a driven shaft driving a stirring blade which is intermittently revolved in a reverse direction to the main driving shaft by a gear drive interposed between the main and driven shaft.

Pursuant to the features of the present invention, there is provided an apparatus for developing a latent image with developer material. The apparatus includes an applicator roller having developer material adhering releasably to at least a portion of the exterior surface thereof. Means are provided for rotating and translating the applicator roller from a non-operative position spaced from the latent image to an operative position closely adjacent the latent image. In this way, the applicator roller transports developer material closely adjacent to the latent image.

In another aspect of the present invention, there is provided an electrophotographic printing machine of the type in which an electrostatic latent image recorded on a photoconductive member is developed with a developer material. The printing machine includes an applicator roller having developer material adhering releasably to at least a portion of the exterior surface thereof. Means are provided for rotating and translating the applicator roller from a non-operative position, spaced from the photoconductive member, to an operative position, closely adjacent the photoconductive member. In this way, the applicator roller transports developer material to the electrostatic latent image recorded on the photoconductive member.

Figure 2:
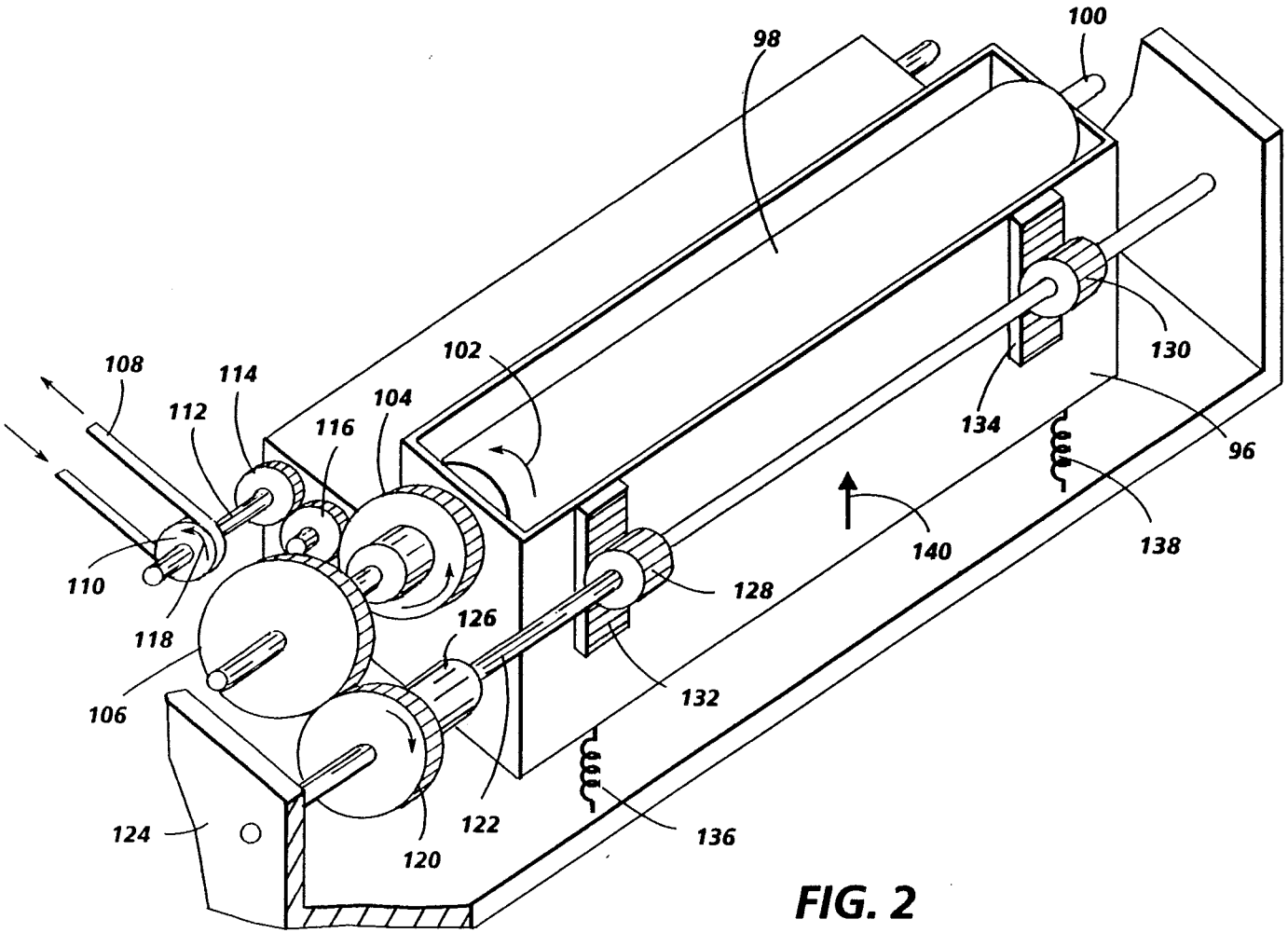

Other aspects of the present invention will become apparent as the following description proceeds and upon reference to the drawings, in which:

FIG. 1 is a schematic elevational view depicting an electrophotographic printing machine incorporating the development apparatus of the present invention therein; and FIG. 2 is a schematic perspective view showing the development apparatus used in the FIG. 1 printing machine.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used through out to designate identical elements. FIG. 1 schematically depicts the various components of an illustrative electrophotographic printing machine incorporating the development apparatus of the present invention therein. It will become evident from the following discussion that the development apparatus of the present invention is equally well suited for use in a wide variety of electrostatographic printing machines, and is not necessarily limited in its application to the particular electrophotographic printing machine shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a photoconductive belt 10. Preferably, the photoconductive belt 10 is made from a photoconductive material coated on a grounding layer, which, in turn, is coated on an anti-curl backing layer. The photoconductive material is made from a transport layer coated on a generator layer. The transport layer transports positive charges from the generator layer. The interface layer is coated on the grounding layer. The transport layer contains small molecules of di-m-tolydiphenylbiphenyldiamine dispersed in a polycarbonate. The generation layer is made from trigonal selenium. The grounding layer is made from a titanium coated Mylar. The grounding layer is very thin and allows light to pass therethrough. Other suitable photoconductive materials, grounding layers, and anti-curl backing layers may also be employed. Belt 10 moves in the direction of arrow 12 to advance successive portions of the photoconductive surface sequentially through the various processing stations disposed about the path of movement thereof. Belt 10 is entrained about idler roller 14 and drive roller 16. Idler roller 14 is mounted rotatably so as to rotate with belt 10. Drive roller 16 is rotated by a motor coupled thereto by suitable means such as a belt drive. As roller 16 rotates, it advances belt 10 in the direction of arrow 12.

Initially, a portion of photoconductive belt 10 passes through charging station A. At charging station A, two corona generating devices, indicated generally by the reference numerals 18 and 20 charge photoconductive belt 10 to a relatively high, substantially uniform potential. Corona generating device 18 places all of the required charge on photoconductive belt 10. Corona generating device 20 acts as a leveling device, and fills in any areas missed by corona generating device 18.

Next, the charged photoconductive surface is rotated to exposure station B. Exposure station B includes a moving lens system, generally designated by the reference numeral 22, and a color filter mechanism, shown generally by the reference numeral 24. An original document 26 is supported stationarily upon a transparent viewing platen 28. Successive incremental areas of the original document are illuminated by means of a moving lamp assembly, shown generally by the reference numeral 30. Mirrors 32, 34 and 36 reflect the light rays through lens 22. Lens 22 is adapted to scan successive areas of illumination of platen 28. The light rays from lens 22 are reflected by mirrors 38, 40, and 42 to be focused on the charged portion of photoconductive belt 10. Lamp assembly 30, mirrors 32, 34 and 36, lens 22, and filter 24 are moved in a timed relationship with respect to the movement of photoconductive belt 10 to produce a flowing light image of the original document on photoconductive belt 10 in a non-distorted manner. During exposure, filter mechanism 24 interposes selected color filters into the optical light path of lens 22. The color filters operate on the light rays passing through the lens to record an electrostatic latent image, i.e. a latent electrostatic charge pattern, on the photoconductive belt corresponding to a specific color of the flowing light of the original document.

Subsequent to the recording of the electrostatic latent image on photoconductive belt 10, belt 10 advances the electrostatic latent image to development station C. Development station C includes four individual developer units generally indicated by the reference numerals 44, 46, 48 and 50. The developer units are of the type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Developer units 44, 46, and 48, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum corresponding to the wave length of light transmitted through the filter. For example, an electrostatic latent image formed by passing the light image through a green filter will record the red and blue portions of the spectrums as areas of relatively high charge density on photoconductive belt 10, while the green light rays will pass through the filter and cause the charge density on the photoconductive belt 10 to be reduced to a voltage level ineffective for development. The charged areas are then made visible by having developer unit 44 apply green absorbing (magenta) toner particles onto the electrostatic latent image recorded on photoconductive belt 10. Similarly, a blue separation is developed by developer unit 46 with blue absorbing (yellow) toner particles, while the red separation is developed by developer unit 48 with red absorbing (cyan) toner particles. Developer unit 50 contains black toner particles and may be used to develop the electrostatic latent image formed from a black and white original document. Each of the developer units is moved into and out of the operative position. In the operative position, the magnetic brush is closely adjacent the photoconductive belt, while, in the non-operative position, the magnetic brush is spaced therefrom. During development of each electrostatic latent image only one developer unit is in the operative position, the remaining developer units are in the non-operative position. This insures that each electrostatic latent image is developed with toner particles of the appropriate color without co-mingling. In FIG. 1, developer unit 44 is shown in the operative position with developer units 46, 48 and 50 being in the nonoperative position. The detailed structure of one of the developer units will be described hereinafter with reference to FIG. 2.

After development, the toner image is moved to transfer station D where the toner image is transferred to a sheet of support material 52, such as plain paper amongst others. At transfer station D, the sheet transport apparatus, indicated generally by the reference numeral 54, moves sheet 52 into contact with photoconductive belt 10. Sheet transport 54 has a pair of spaced belts 56 entrained about three rolls 58, 60 and 62. A gripper 64 extends between belts 56 and moves in unison therewith. Sheet 52 is advanced from a stack of sheets 72 disposed on tray 74. Feed roll 77 advances the uppermost sheet from stack 72 into the nip defined by forwarding rollers 76 and 78. Forwarding rollers 76 and 78 advance sheet 52 to sheet transport 54. Sheet 52 is advanced by forwarding rollers 76 and 78 in synchronism with the movement of gripper 64. In this way, the leading edge of sheet 52 arrives at a preselected position to be received by the open gripper 64. The gripper then closes securing the sheet thereto for movement therewith in a recirculating path. The leading edge of the sheet is secured releasably by gripper 64. As the belts move in the direction of arrow 66, the sheet 52 moves into contact with the photoconductive belt, in synchronism with the toner image developed thereon, at the transfer zone 68. A corona generating device 70 sprays ions onto the backside of the sheet so as to charge the sheet to the proper magnitude and polarity for attracting the toner image from photoconductive belt 10 thereto. Sheet 52 remains secured to gripper 64 so as to move in a recirculating path for three cycles. In this way, three different color toner images are transferred to sheet 52 in superimposed registration with one another. Thus, the aforementioned steps of charging the photoconductive surface, exposing the photoconductive surface to a specific color of the flowing light image of the original document, developing the electrostatic latent image recorded on the photoconductive surface with appropriately colored toner, and transferring the toner images to the sheet of support material are repeated a plurality of cycles to form a multi-color copy of a colored original document.

After the last transfer operation, grippers 64 open and release sheet 52. Conveyor 80 transports sheet 52, in the direction of arrow 82, to fusing station E where the transferred image is permanently fused to sheet 52. Fusing station E includes a heated fuser roll 84 and a pressure roll 86. Sheet 52 passes through the nip defined by fuser roll 84 and pressure roll 86. The toner image contacts fuser roll 84 so as to be affixed to sheet 52. Thereafter, sheet 52 is advanced by forwarding roll pairs 88 to catch tray 90 for subsequent removal therefrom by the machine operator.

The last processing station in the direction of movement of belt 10, as indicated by arrow 12 is cleaning station F. A rotatably mounted fibrous brush 92 is positioned in cleaning station F and maintained in contact with photoconductive belt 10 to remove residual toner particles remaining after the transfer operation. Thereafter, lamp 94 illuminates photoconductive belt 10 to remove any residual charge remaining thereon prior to the start of the next successive cycle.

Referring now to FIG. 2, there is shown developer unit 44. Only development unit 44 will be described in detail as developer units 46, 48 and 50 are substantially identical thereto, the distinction between each developer unit being the color of the toner particles contained therein. Developer unit 44 may have magenta toner particles, unit 46 yellow toner particles, unit 48 cyan toner particles, and developer unit 50 black toner particles, although different color combinations may be used. For purposed of explanation, development unit 44 will hereinafter be described in detail. Developer unit 44 includes a housing 96 defining a chamber having applicator roller 98 mounted at least partially, therein. Applicator roller 98 is mounted rotatably in the chamber of housing 96. Shaft 100 supports applicator roller 98 rotatably on suitable bearings in the end walls of housing 96. Applicator roller 98 has a stationary cylindrical magnet disposed interiorly of a rotating sleeve. Inasmuch as the carrier granules of the developer material are magnetic, the developer material is attracted to the exterior circumferential surface of the sleeve so as to be transported therewith closely adjacent to the photoconductive belt. In this way, the toner particles are attracted to the electrostatic latent image forming a toner powder image thereof. Applicator roller 98 is rotated in the direction of arrow 102 to transport the developer material from the chamber of housing 96 to the photoconductive belt when housing 96 is in the operative position. Gear 104 is mounted on shaft 100 exterior to housing96. Clutch gear 106 is also mounted on shaft 100 exterior to housing 96. Gear 104 is positioned on shaft 100 between an end wall of housing 96 and clutch gear 106. A motor (not shown) drives belt 108 entrained about pulley 110 mounted on shaft 112. Gear 114 is mounted on shaft 112 and meshes with idler gear 116. Idler gear 116 meshes with gear 104. In this manner, energization of the motor drives belt 108 to rotate pulley 110 in the direction of arrow 118. As pulley 110 rotates in the direction of arrow 118, shaft 112 rotates therewith. Gear 114, mounted on shaft 112, also rotates in the direction of arrow 118. Gear 114 drives idler gear 116 in the opposite direction to that of arrow 118. Idler gear 116, in turn, meshes with gear 104 and rotates it in the direction of arrow 118. As gear 104 rotates in the direction of arrow 118, shaft 100 rotates therewith causing clutch gear 106 to also rotate in the direction of arrow 118. Clutch gear 106 meshes with gear 120 mounted on shaft 122. Shaft 122 is mounted rotatably in frame 124 of the printing machine. A constant torque slip clutch 126 couples gear 120 to shaft 122. Pinion gears 128 and 130, mounted on shaft 122, mesh with racks 132 and 134. Racks 132 and 134 are spaced apart from one another and secured to an exterior surface of a side wall of housing 96. Springs 136 and 138 are spaced apart and secured to the exterior surface of the bottom of housing 96. Preferably, springs 136 and 138 are coil springs which extend when housing 96 moves from the non-operative position to the operative position. In this way, springs 136 and 138 resiliently urge housing 96 from the operative position to the non-operative position. One skilled in the art will appreciate that any suitable spring may be used to resiliently urge housing from the operative position, wherein applicator roller 98 is adjacent photoconductive belt 10, to the non-operative position, wherein applicator roller 98 is spaced from photoconductive belt 10.

In operation, the motor drives belt 108 causing pulley 110 to rotate in the direction of arrow 118. As pulley 110 rotates, shaft 112 rotates therewith driving gear 114. Gear 114 rotates idler gear 116 which in turn, rotates gear 104 in the direction of arrow 118. As clutch gear 104 rotates in the direction of arrow 118, shaft 100 rotates causing gear 106 to rotate therewith. Shaft 100 rotates applicator roller 98 in the direction of arrow 102. Gear 106 rotates gear 120 in the opposite direction to that of arrow 118. Shaft 122 rotates in that direction, as does pinion gears 128 and 130. As pinion gears 128 and 130 rotate, they drive racks 132 and 134 in the direction of arrow 140. This causes housing 96 to move in the direction of arrow 140 from the non-operative position to the operative position. As housing 96 translates from the non-operative position to the operative position, springs 136 and 138 extend exerting a force on the housing in a direction back toward the non-operative position. When housing 96 is in the operative position, stops prevent further translation thereof and clutch 126 slips. This enables shaft 100 to continue rotating the applicator roller when the housing is in the operative position so as to transport the developer material closely adjacent to the photoconductive belt so as to develop the electrostatic latent image thereon. After development of the electrostatic latent image is completed, the motor is de-energized. Belt 108 no longer drives pulley 110 and thus, gears 114, 116, 104 and 106 no longer rotate. Preferably, clutch gear 104 is a mechanical one-way clutch. The force exerted by springs 136 and 138 on housing 96 causes housing 96 to move from the operative position to the non-operative. When housing 96 translates in an upwardly direction from the non-operative position to the operative position, the force of gravity opposes this translation and assists the movement in the downwardly direction from the operative position to the non-operative position. As housing 96 moves from the operative position to the non-operative position, racks 132 and 134 rotate pinion gears 128 and 130 in the opposite direction, i.e. in the same direction as arrow 118, causing shaft 122 to rotate gear 120 in this direction. Gear 120 now rotates gear 106 in the opposite direction to arrow 118 causing shaft 100 to rotate in this direction. As shaft 100 rotates in the opposite direction to arrow 118, applicator roller 98 rotates in the opposite direction to arrow 102. As applicator roller rotates in the opposite direction to arrow 102, it returns the developer material on its surface to the chamber of housing 96 terminating development. Thus, the applicator roller rotates about one half a revolution in the opposite direction to its' normal direction as the housing translates from the operative position to the non-operative position. In this manner, the developer material of developer unit 44 is spaced from the photoconductive belt before the next developer unit is positioned in the operative position to effect development of the next successive latent image with different color developer material precluding intermingling of the different color developer materials.

When developer unit 44 is operative, developer units 46, 48 and 50 are inoperative. Alternatively, if one of the other developer units is in the operative mode, developer unit 44 must be in the inoperative mode. In this manner, when the electrostatic latent image is formed with a green filter, developer unit 44 is operative. At other times, developer unit 44 is inoperative. When the electrostatic latent image is formed with a red filter, developer units 44, 46 and 50 are inoperative and developer unit 48 is operative. Finally, when the electrostatic latent image is formed with a blue filter, developer unit 46 is operative and developer units 44, 48 and 50 are inoperative. In this manner, successive electrostatic latent images are developed with differently colored toner particles. As previously indicated, the toner particles form toner powders image on photoconductive belt 10 which are subsequently transferred to sheet material 52 (FIG. 1) in superimposed registration with one another to form the resultant multicolor toner powder image thereon.

In recapitulation, the development apparatus of the present invention rotates the applicator roller in the developer housing simultaneously with the translation of the developer housing to and from the operative position. As the developer housing returns from the operative position to the non-operative position, after development has terminated, the applicator roller rotates about one half a revolution in the opposite direction to its normal direction of rotation spacing the developer material from the photoconductive belt. This prevents intermingling of different color toner particles on the same electrostatic latent image.

It is, therefore, evident that there has been provided in accordance with the present invention, a development apparatus that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

I claim:

1. An apparatus for developing a latent image with developer material, including:

an applicator roller mounted rotatably about its longitudinal axis and having developer material adhering releasably to at least a portion of the exterior surface thereof; and means for rotating said applicator roller about its longitudinal axis, and, as said applicator roller rotates about its longitudinal axis through an initial angle of rotation, translating said applicator roller from a nonoperative position spaced from the latent image to an operative position closely adjacent the latent image so that said applicator roller transports developer material closely adjacent to the latent image.

2. An apparatus according to claim 1, further including means for moving said applicator roller from the operative position to the nonoperative position.

3. An apparatus for developing a latent image with developer material, including:

an applicator roller mounted rotatably about its longitudinal axis and having developer material adhering releasably to at least a portion of the exterior surface thereof;

means for rotating said applicator roller about its longitudinal axis, and, as said applicator roller rotates about its longitudinal axis through an initial angle of rotation, translating said applicator roller from a nonoperative position spaced from the latent image to an operative position closely adjacent the latent image so that said applicator roller transports developer material closely adjacent to the latent image; and means for moving said applicator roller from the operative position to the non-operative position, said rotating and translating means, responsive to said moving means moving said applicator roller from the operative position to the nonoperative position, rotates said applicator roller in a direction opposed to the direction for transporting developer material closely adjacent to the latent image so as to space the developer material from the latent image.

4. An apparatus according to claim 3, wherein said moving means includes means for resiliently urging said applicator roller from the operative position toward the non-operative position.

5. An apparatus according to claim 4, further including a housing having said applicator roller mounted rotatably therein.

6. An apparatus according to claim 5, wherein said rotating and translating means includes:

a rack mounted on said housing;

a gear meshing with said rack; and means for rotating said applicator roller and said gear so that as said applicator roller rotates, said housing translates with said applicator roller from the non-operative position to the operative position.

7. An apparatus according to claim 6, wherein said resilient urging means includes;

at least one spring secured to said housing, said spring exerting a force on said housing so that de-energization of said rotating means moves said housing from the operative position to the non-operative position, said rack moving with said housing and rotating said gear in a direction opposed to the direction for translating said housing from the non-operative position to the operative position; and means, responsive to said gear rotating in a direction opposed to the direction for translating said housing from the non-operative position to the operative position, for rotating said applicator roll in a direction opposed to the direction that said applicator roll rotates when said housing translates from the non-operative position to the operative position.

8. An electrophotographic printing machine of the type in which an electrostatic latent image recorded on a photoconductive member is developed with a developer material, wherein the improvement includes:

an applicator roller mounted rotatably about its longitudinal axis and having developer material adhering releasably to at least a portion of the exterior surface thereof; and means for rotating said applicator roller about its longitudinal axis, and, as said applicator roller rotates about its longitudinal axis through an initial angle of rotation, translating said applicator roller from a nonoperative position, spaced from the photoconductive member, to an operative position, closely adjacent the photoconductive member, so that said applicator roller transports developer material to the electrostatic latent image recorded on the photoconductive member.

9. A printing machine according to claim 8, further including means for moving said applicator roller from the operative position to the non-operative position.

10. An electrophotographic printing machine of the type in which an electrostatic latent image recorded on a photoconductive member is developed with a developer material, wherein the improvement includes:

an applicator roller mounted rotatably about its longitudinal axis and having developer material adhering releasably to at least a portion of the exterior surface thereof;

means for rotating said applicator roller about its longitudinal axis, and, as said applicator roller rotates about its longitudinal axis through an initial angle of rotation, translating said applicator roller from a nonoperative position, spaced from the photoconductive member, to an operative position, closely adjacent the photoconductive member, so that said applicator roller transports developer material to the electrostatic latent image recorded on the photoconductive member; and means for moving said applicator roller from the operative position to the non-operative position, said rotating and translating means, responsive to said moving means moving said applicator roller from the operative position to the non-operative position, rotates said applicator roller in a direction opposed to the direction for transporting developer material to the electrostatic latent image recorded on the photoconductive member so as to space the developer material from the latent image.

11. A printing machine according to claim 10, wherein said moving means includes means for resiliently urging said applicator roller from the operative position toward the inoperative position.

12. A printing machine according to claim 11, further including a housing having said applicator roller mounted rotatably therein.

13. A printing machine according to claim 12, wherein said rotating and translating means includes:

a rack mounted on said housing;

a gear meshing with said rack; and means for rotating said applicator roller and said gear so that as said applicator roller rotates, said housing translates with said applicator roller from the non-operative position to the operative position.

14. A printing machine according to claim 13, wherein said resilient urging means includes;

at least one spring secured to said housing, said spring exerting a force on said housing so that de-energization of said rotating means moves said housing from the operative position to the non-operative position, said rack moving with said housing and rotating said gear in a direction opposed to the direction for translating said housing from the non-operative position to the operative position; and means, responsive to said gear rotating in a direction opposed to the direction for translating said housing from the non-operative position to the operative position, for rotating said applicator roll in a direction opposed to the direction that said applicator roll rotates when said housing translates from the non-operative position to the operative position.

* * * * *